US006540077B2

(12) United States Patent
Yasui et al.

(10) Patent No.: US 6,540,077 B2
(45) Date of Patent: Apr. 1, 2003

(54) PHOTOGRAPHIC ROLL FILM HAVING SEALING TAPE

(75) Inventors: Mototada Yasui, Kanagawa (JP); Nobuo Sugiyama, Kanagawa (JP); Hiroyuki Kurabayashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/769,738

(22) Filed: Jan. 26, 2001

(65) Prior Publication Data

US 2001/0027928 A1 Oct. 11, 2001

(30) Foreign Application Priority Data

Jan. 26, 2000 (JP) ..... 2000-016849

(51) Int. Cl.[7] ..... B65D 85/66
(52) U.S. Cl. ..... 206/398; 206/411
(58) Field of Search ..... 206/389, 397, 206/398, 400, 401, 411, 416, 455; 242/343.4; 430/501

(56) References Cited

U.S. PATENT DOCUMENTS 4,161,249 A * 7/1979 Dashow ..... 116/200
4,733,777 A * 3/1988 Van Geyte et al. ..... 206/400
5,133,171 A * 7/1992 Chase et al. ..... 206/400
5,353,933 A * 10/1994 Takahashi et al. ..... 206/398
5,683,775 A * 11/1997 Franklin ..... 206/411
6,074,747 A * 6/2000 Scholz et al. ..... 206/411
6,100,017 A * 8/2000 Makino et al. ..... 206/316.1

FOREIGN PATENT DOCUMENTS

JP 11-271935 10/1999
JP 11-271936 10/1999

* cited by examiner

*Primary Examiner*—Shian Luong
(74) *Attorney, Agent, or Firm*—Sughrue Mion, PLLC

(57) ABSTRACT

The invention relates to a photographic roll film such as Brownie film, particularly to a sealing tape, used for the photographic roll film, which can seal a roll of film easily and reliably without the need for licking adhesive on a sealing tape as in a conventional one. The sealing tape includes a bonding portion and a release portion which are made of a single tape base. The bonding portion has a bond layer coated on the tape base for securing the sealing tape to a surface of light-shielding paper, the release portion made of a folded-over portion formed by folding over the tape base includes a tacky layer and a release layer inside the folded-over portion which are coated on the tape base separately and directly face each other and an end of the tape base is secured to the end portion of the bond layer.

24 Claims, 16 Drawing Sheets

PHOTOGRAPHIC ROLL FILM HAVING SEALING TAPE

FIELD OF THE INVENTION

The present invention relates to a photographic roll film such as Brownie film, particularly a sealing tape, used for the photographic roll film, which can seal a roll of film easily and reliably with no need to lick adhesive on a sealing tape as in a conventional one.

BACKGROUND OF THE INVENTION

A photographic roll film such as Brownie film is made of an approximately 6 cm wide photographic film strip which is wound around a spool and secured by a sealing tape. 120 type and 220 type are well known as the roll film products. A film strip of the 120 type is covered with a light-shielding backing paper (so-called "leader paper") which is longer than the film strip. A film strip of the 220 type has a light-shielding leader paper (so-called "leader") spliced to a leading end portion thereof and a light-shielding trailer paper (so-called"trailer") spliced to a trailing end portion thereof, which is about twice as long as the 120 type.

The film strip of the roll film wound around a spool loaded in a loading chamber of camera is wound by a take-up spool set in a winding chamber of the camera as an exposure is made. A trailing end of the film strip and a trailing end of the light-shielding backing paper or the light-shielding trailer are detached from the spool in the loading chamber to be wound up around the take-up spool in the winding chamber. A sealing tape, of which part is coated with an adhesive to be activated by being wet, is secured to the outer surface of the trailing end portion of the light-shielding paper.

A user detaches the roll of film wound around the take-up spool from the camera, then partially pulls up the sealing tape to lick and activate the adhesive coated portion and pastes the portion on the surface of the light-shielding paper across the trailing end edge to seal the roll of exposed film while keeping the light-shielding paper tight by using his fingers. It is, however, unpleasant and unsanitary to lick the adhesive and may be bad for the health of a heavy user. Sealing tapes which work without getting wet have been developed.

Japanese Laid-open Patent 104803/98 (tokkai-hei 10-104803) shows a roll film of which sealing tape secured to a light-shielding paper on its trailing end portion has an adhesive/tacky layer portion and a release layer portion on the same side which directly face each other by folding the tape over. After exposing the entire photographic film strip, the sealing tape is unfolded and the adhesive layer portion is adhered to a light-shielding paper to seal.

Japanese Laid-open Patent 271935/99 (tokkai-hei 11-271935) shows a roll film of which sealing tape is folded in a Z-shape to make an adhesive layer portion and a release layer portion that directly face each other.

Japanese Laid-open Patent 271936/99 (tokkai-hei 11-271936) shows a sealing tape coated with an adhesive which is divided into three portions by placing a release layer on a light-shielding paper, a secured-to-light-shielding-paper portion, an easily peelable portion facing the release layer and a provisionally-secured-to-light-shielding-paper portion which is peeled off after exposing the entire photographic film strip. Most of the sealing tape other than the secured-to-light-shielding-paper portion can be used as an adhesive tape for sealing the roll of film.

In the roll film shown in the above-noted Japanese Laid-open Patent 104803/98 (tokkai-hei 10-104803), however, the adhesive material tends to cause contamination and broken portions of the sealing tape may be left in the camera. As shown in FIG. 25, the sealing tape 82 is secured to the light-shielding paper only on its trailing end portion, which causes the sealing tape to be bent when the light-shielding paper is transported in the camera and a leading edge of the sealing tape 82 hits an end of spring member 81 for preventing the roll of film from loosening. In the following stage as shown in FIG. 26, the sealing tape 82 is bent over along a line close to the trailing end portion, which causes a border area between the adhesive layer and the release layer to be exposed, and then the bent sealing tape is transported as shown in FIG. 27. Finally, as shown in FIG. 28, the originally folded-over portion including the tacky layer and the release layer inside becomes unfolded to expose respective layers by a film supporting member 83 of the camera, which may cause contamination with the tacky material or leave a broken portion of the sealing tape in the camera.

In the sealing tape folded in a Z-shape as disclosed in the above-noted Japanese Laid-open Patent 271935/99 (tokkai-hei 11-271935), edges of a pair of a tacky layer and a release layer are exposed, which causes the same problem such that the folded-over portion including the pair of layers becomes unfolded as the sealing tape on the light-shielding paper advances in the camera and causes tacky contamination.

In the sealing tape in the above-noted Japanese Laid-open Patent 271936/99 (tokkai-hei 11-271936), it is inconvenient and not so easy to peel off the leading edge of the sealing tape which is provisionally secured to the light-shielding paper.

SUMMARY OF THE INVENTION

An object of the invention is to provide a photographic roll film which can be sealed easily and reliably with no need to lick adhesive on a sealing tape as in a conventional one.

To accomplish the object, the following photographic roll film with improved sealing tape is provided.

A photographic roll film comprising: a spool, a roll of photographic film strip wound around the spool, a light-shielding paper for covering the roll of the photographic film strip, and a sealing tape for keeping the light-shielding paper covering the roll of the photographic film strip without loosening wherein the sealing tape includes a bonding portion and a release portion which are made of single tape base. A first bond layer is coated on the tape base in the bonding portion for securing a first end of the sealing tape to a surface of the light-shielding paper and a folded-over portion is formed in the release portion by folding over the tape base. A first tacky layer and a release layer are separately coated on the tape base inside the folded-over portion and directly face each other, and a second end of the tape base is secured to an end portion of the first bond layer. The photographic roll film may be provided with a second bond layer or a second tacky layer that is coated on the second end portion of the tape base and glued to the first bond layer.

The invention further provides a tab for easily unfolding the sealing tape, which is formed in the tape base of the folded-over portion accompanied by a perforated-line for tearing off a part of the tape base to unfold the folded-over portion and expose the first tacky layer by which the light-shielding paper around the roll of photographic film strip is sealed.

Usually the tab and the first tacky layer are located close to each other to make the effective sealing length as long as possible. Thus, the tab and the first tacky layer are formed on the same part of the tape base with respect to the folded-over portion.

Usually the sealing tape is secured to the outer surface of the light-shielding paper. In the present invention, it is possible to fix the sealing tape on the inner surface of the light-shielding paper.

For this purpose, the invention provides for the bonding portion to be secured to an inner surface of the light-shielding paper so as to be located in the leading side of the sealing tape in the film advancing direction, and the tab and the first tacky layer are formed with respect to one side tape base of the folded-over portion away from the light-shielding paper. In this case, the tab is located outside of the sealing tape, which makes it easier to pick up the tab.

Some other modified sealing tapes are also developed as discussed below, where the release portions are formed to have an S-shape or a Z-shape.

As S-shaped, the sealing tape includes a bonding portion and a release portion which are made of a single tape base, the bonding portion has a first folded-over portion formed by folding over the tape base and a first bond layer coated in one side of the first folded-over portion for securing a first end of the sealing tape to a surface of the light-shielding paper. The release portion is made of a second folded-over portion and is formed by folding over the tape base, which is connected to the first folded-over portion to form the S-shape, and includes a first tacky layer and a release layer that are separately coated on the tape base inside the second folded-over portion and directly face each other. A tab is formed in the second folded-over portion accompanied by a perforated-line for tearing off a part of the tape base to unfold the second folded-over portion and expose the first tacky layer to seal the light-shielding paper. A second bond layer or a second tacky layer is coated on the second end portion of the tape base and is secured to the tape base.

The invention provides for another S shape wherein the sealing tape includes a bonding portion and a release portion which are made of a single tape base. The bonding portion has a first folded-over portion formed by folding over the tape base and a bond layer for securing the sealing tape to a surface of the light-shielding paper. The release portion is made of an S-shaped folded-over portion formed by folding the tape base twice and includes a tacky layer and a release layer inside the upper fold-over of the S-shaped folded-over portion which are coated on the tape base separately and directly face each other and an adhesive layer inside the lower folded-over of which adhesive strength is less than that of the bond layer of the bonding portion so that a user can easily peel it off.

As Z-shaped, the sealing tape includes a bonding portion and a release portion which are made of a single tape base, the bonding portion has a bond layer coated on the tape base for securing the sealing tape to a surface of the light-shielding paper. The release portion, made of a folded-over portion formed by folding over the tape base, includes a tacky layer and a release layer that are separately coated on the tape base inside the folded-over portion and directly face each other, and a second end portion of the tape base is folded back to form the Z-shape. This fold back portion can be an alternative for the tab.

As a further modified S-shape, the sealing tape includes a bonding portion and a release portion which are made of a single tape base, the bonding portion has a first folded-over portion formed by folding over the tape base and a bond layer coated on one side of the first folded-over portion for securing the sealing tape to a surface of the light-shielding paper. The release portion is made of a second folded-over portion formed by folding over the tape base, which is connected to the first folded-over portion to form the S-shape, and includes a tacky layer and a release layer inside the second folded-over portion which are coated on the tape base separately and directly face each other, and a second end portion of the tape base is folded back.

DETAILED DESCRIPTION OF THE PREFERRED EMBODIMENTS

Embodiment 1

Figure 2:
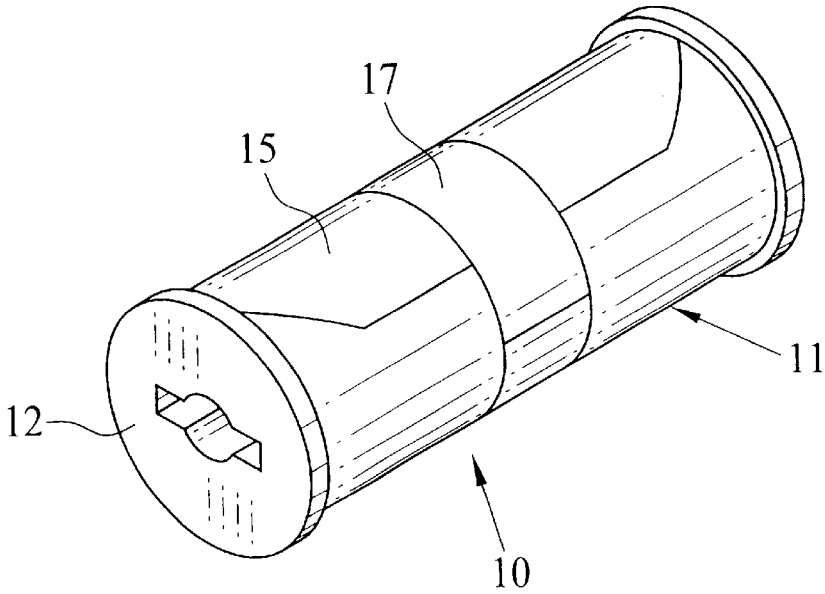
FIG. 2 shows an external perspective view of a roll film.
Figure 3:
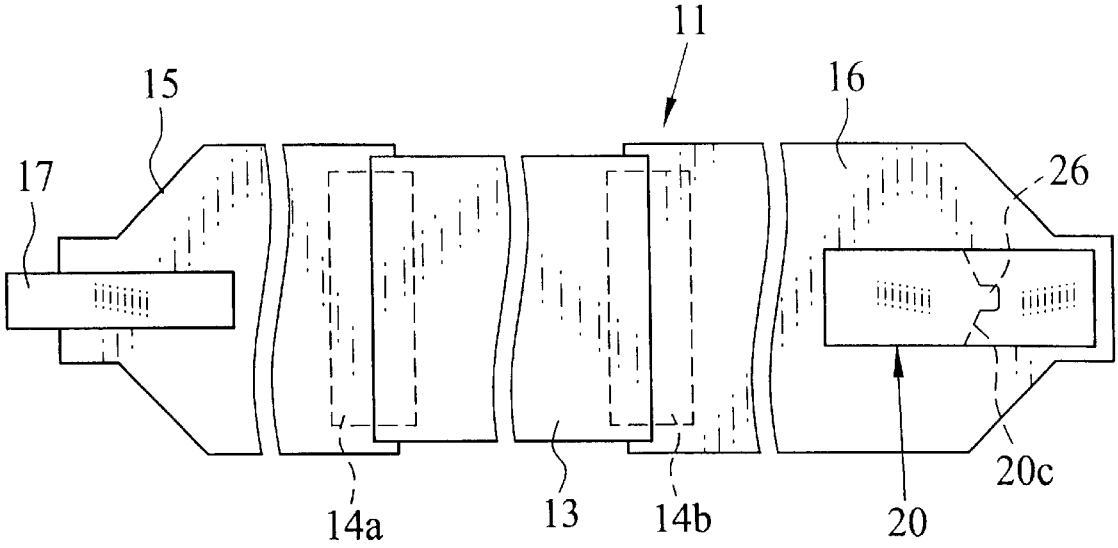
FIG. 3 shows a spread view of a roll film with light-shielding paper of Embodiment 1 of the invention.

FIGS. 2 and 3 illustrate 220 type of photographic roll film. A photographic roll film 10 includes a photographic film strip with light-shielding paper 11 and a spool 12. The photographic film strip with light-shielding paper 11 includes a photographic film strip 13, a light-shielding leader (paper) 15 spliced to a leading end portion of the photographic film strip 13 with a splicing tape 14*a* and a light-shielding trailer (paper) 16 spliced to a trailing end portion of the film strip 13 with a splicing tape 14*b*. The light-shielding leader 15 and the light-shielding trailer 16 have enough length respectively to cover a roll of the film strip 13 so as to prevent unexposed photographic film strip and exposed photographic film strip after taking picture from being exposed by ambient light.

A roll-of-film opening tape 17 is secured to the outer surface of the light-shielding leader 15 to keep the light-shielding leader covering a roll of unexposed film strip from loosening. The splicing tape 14*a* has a bar code on the surface indicating a type of photographic film 13 and/or ISO film speed and the like. A camera reads the bar code by a bar code reader installed therein to memorize the film information.

The light-shielding trailer 16 is located in the core area of the roll of unexposed photographic film before its use. A roll-of-film sealing tape 20 (hereinafter referred to simply as sealing tape) is secured to the outer surface of the light-shielding trailer 16 to keep the light-shielding trailer 16, which is to cover a roll of exposed film strip after being wound around the take-up spool, from loosening.

Figure 4:
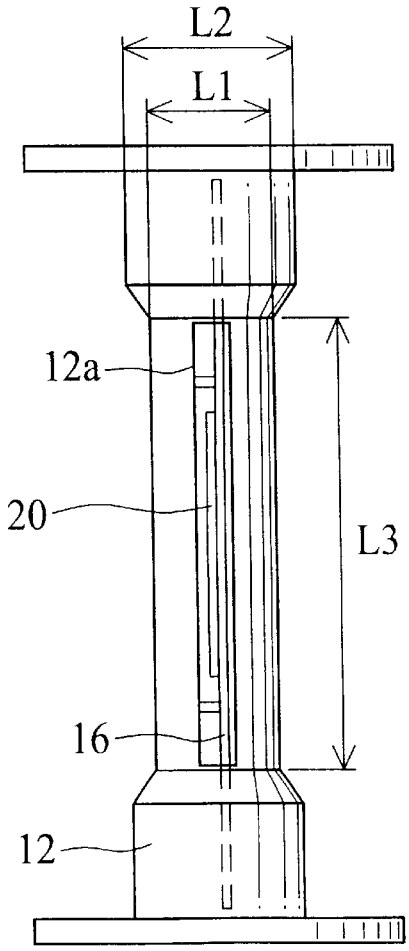
FIG. 4 shows a schematic sectional view of a spool used for the invention.

As shown in FIG. 4, end portions of the light-shielding trailer 16 and the sealing tape 20 are held in a slit 12*a* formed in a spool 12. A diameter of a central portion L1 of the spool 12 is smaller than that of an end portion L2 by 0.1 mm–0.6 mm to receive the thickness of the sealing tape, which can prevent the photographic film from being fogged by pressure. A length of the smaller diameter portion L3 of the spool should be at least more than a width of the sealing tape (about 20 mm), usually from 20 mm to 50 mm and preferably from 30 mm to 40 mm.

Figure 1:
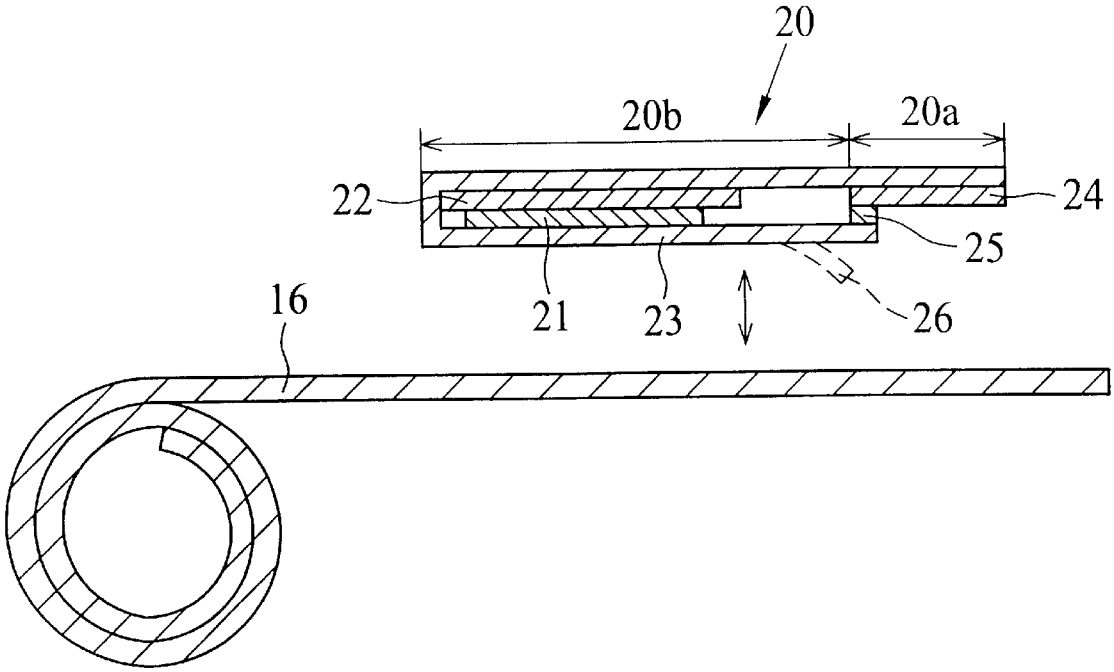
FIG. 1 shows a cross-sectional view of a sealing tape of Embodiment 1 of the invention.

A cross-sectional view of the sealing tape 20 is shown in FIG. 1. The sealing tape including a tape base 23 made of paper or synthetic paper securely adheres to the light-shielding trailer 16 at its bonding portion 20*a* via a first bond layer 24 coated on one end portion of the tape base. (Hereinafter one end of the tape base 23 close to the bond layer 24 where the sealing tape 20 is secured to the light-shielding trailer 16 is defined as the first end of the tape base, and the other end of the tape base 23 is defined as the second end of the tape base. Also one portion of the sealing tape 20 where the bond layer 24 is secured to the light-shielding trailer 16 is defined as a bonding portion of the sealing tape and the other portion of the sealing tape 20 is defined as a release portion of the sealing tape.)

The other portion of the tape base 23 is folded over toward the light-shielding trailer 16. The folded-over portion (release portion of the sealing tape) has an inside which includes a tacky layer 21 and a release layer 22 which are weakly adhered to each other. A second bond layer 25 is coated on the other end portion (second end portion) of the folded-back tape base 23 to adhere securely to part of the first bond layer 24.

The bonding portion 20*a* of the sealing tape 20 fixed on the light-shielding trailer 16 is located in the trailing side in a film advancing direction.

The tacky layer 21, the release layer 22, the first bond layer 24 and the second bond layer 25 are formed on the tape base 23 by printing or the like before folding-over of the tape base 23 is made. Release layer 22 makes it easy for a layer or the like adhering thereto to be peeled off therefrom. Usually silicon compounds are used for the release layer 22, a heat-sealing type bonding agent or a pressure-sensitive adhesive is available for the first and second bond layers 24 and 25, and pressure-sensitive adhesives are available for the tacky layer 21 which can be formed by means such that a release paper on which the pressure-sensitive adhesive is coated is once pressed against the tape base 23 and then peeled off from the tape base 23, or a hot-melt type pressure-sensitive adhesive which is coated directly on the tape base 23 by extrusion coating.

As bond layers 24 and 25, a bonding agent or a pressure-sensitive adhesive may be used. The bonding agent has such characteristics to be in a liquid state in applying, to spread by wetting adhered surface, to generate a proper cohesive power by solidifying after application and to have resistance against destruction by reciprocal interaction with the adhered surface. In classifying the bonding agent by formation, there are a solution type and an emulsion type. In classifying chemically, there are a phenol resin type, an acrylic resin type and an epoxy resin type. In classifying by the main component, there are a rubber type, a thermoplastic resin type, and a thermosetting resin type.

The pressure-sensitive adhesive is usually used as the main component of the adhesive tape. This adhesive has characteristics such that it does not change into a solid state from a liquid state after application and has practical tackiness in a liquid state. Thus, the tacky layer keeps its gluing power after being peeled from the release layer, so it is possible to re-glue the tacky layer to the release layer. The elasticity of the pressure-sensitive adhesive is equal to or less than $10^7$ dyn/cm$^2$. The pressure-sensitive adhesives have a rubber type and an acrylic type. The main component of the rubber type is a synthetic rubber, such as a natural rubber, an SBR and so forth. The main component of the acrylic type is a copolymer generated by an acrylic monomer and a monomer with a functioning group.

Figure 5:
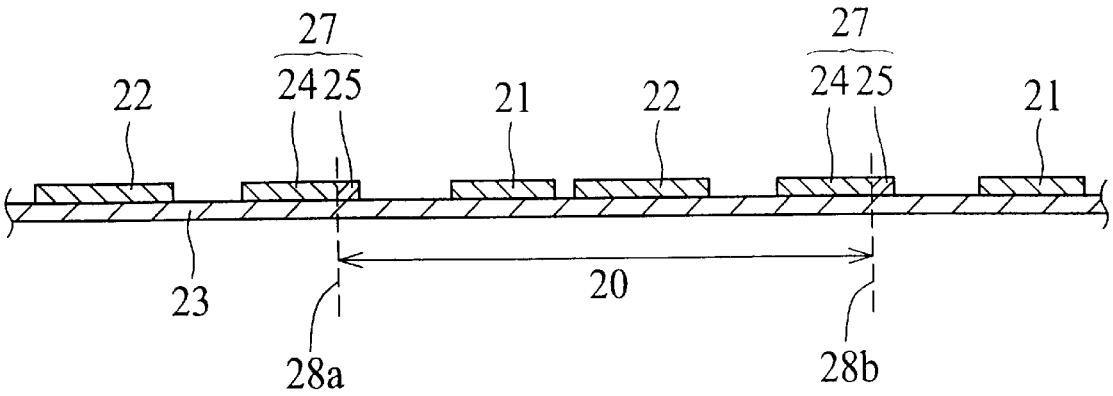
FIG. 5 shows an explanatory diagram of cutting a tape base during manufacturing of the sealing tape of Embodiment 1 of the invention.

FIG. 5 illustrates how to make the sealing tape 20. The tape base 23 has a plurality of the tacky layers 21, the release layers 22 and the bond layers 27. First, the tape base 23 is cut off along broken lines 28*a* and 28*b*, which divides the bond layer 27 into two parts, the first bond layer 24 and the second bond layer 25. Second, the tape base 23 is folded over along the line between the tacky layer 21 and the release layer 22 to make the second bond layer 25 adhere to the end portion of the first bond layer 24.

As shown in FIGS. 1 and 3, a tab 26 is formed, by incising on the folded-back portion of the tape base 23, between the fold and the end portion (second end portion) of the tape base 23 where the second bond layer 25 is formed. Perforations 20*c* for tearing off are formed on both sides of the tab 26. A tip of the tab 26 is positioned away from the second bond layer 25. The folded-over tape base 23 can be unfolded and spread out by pulling apart the tab 26 after pulling up the fold portion by using a finger, which exposes the tacky layer 21 facing toward the outer surface of the light-shielding trailer 16.

The roll film 10 is loaded in the film-loading chamber and a leading edge portion of the light-shielding leader 15 is attached to the take-up spool. The photographic film 13 is taken up around the take-up spool after each shooting. After all of the frames are exposed, the light-shielding trailer 16 is transported in the camera and finally taken up. While being transported, the sealing tape 20 becomes bent over along the border between the bonding portion 20*a* and the release portion 20*b* because the sealing tape 20 is secured to the light-shielding trailer 16 only by the bonding portion 20*a* disposed in a trailing side of the sealing tape, which is similar to what happens in the conventional way previously explained with respect to FIGS. 25 to 28.

However, the tacky layer 21 is never peeled off from the release layer 22 to be exposed as in the conventional way because the second bond layer 25 at the edge of the release portion 20*b* securely adheres to the first bond layer 24 of the bonding portion 20*a*. Therefore, no contamination by the exposed adhesive arises in the camera. After the light-shielding trailer 16 is wound around the take-up spool, the roll of film 10 is taken out of the camera.

Figure 6:
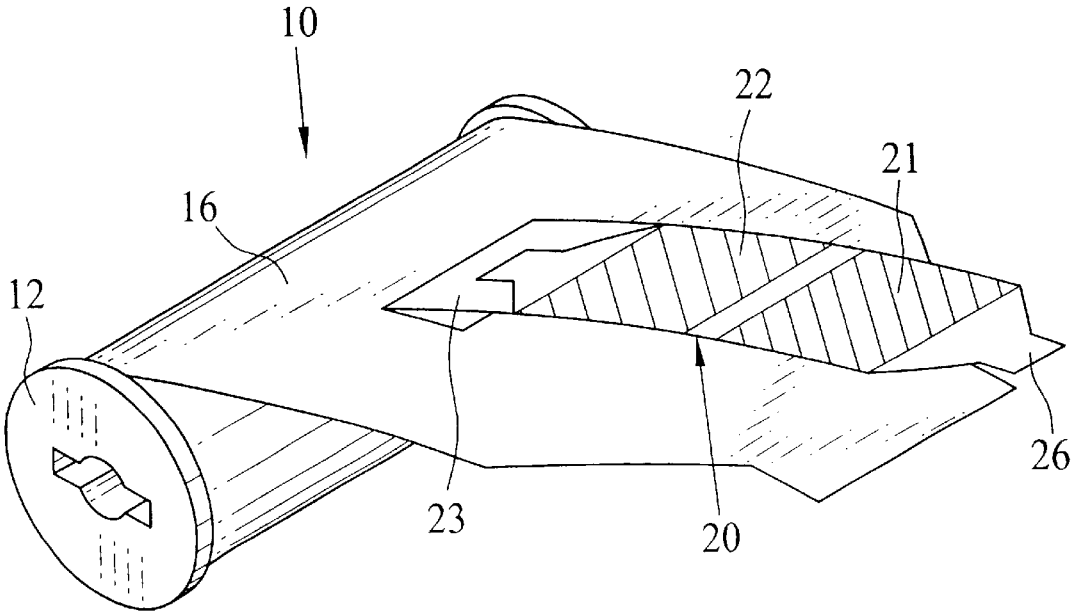
FIG. 6 shows an external perspective view of a fully exposed roll film with unfolded sealing tape of Embodiment 1 of the invention.
Figure 7:
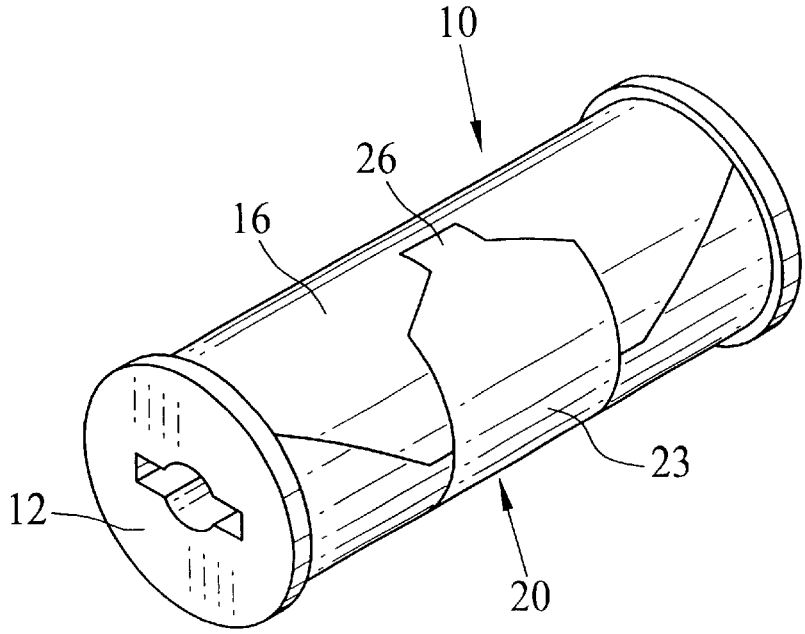
FIG. 7 shows an external perspective view of a roll film sealed by a sealing tape of the invention.

The sealing tape 20 on the roll of film 10 taken out of the camera is already bent over to expose the tab 26. A user can easily pull up the tab 26 along the perforated-line for tearing-off to unfold the sealing tape 20 so that the tacky layer 21 is separated from the release layer 22 to be exposed as shown in FIG. 6, then the user wraps the unfolded and spread-out sealing tape 20 around the roll of film 10 in the same winding direction across the trailing edge of the light-shielding trailer 16 and presses the tacky layer 21 against the surface of the trailer 16 as shown in FIG. 7 while preventing the roll of film 10 from loosening.

In the above Embodiment 1, it is possible to remove the second bond layer 25 and to have the release layer or both the release layer and the tacky layer in the area beneath the tab 26. The second end portion of the tape base 23 can adhere to the first bond layer 24 without the second bond layer 25.

Embodiment 2

Figure 8:
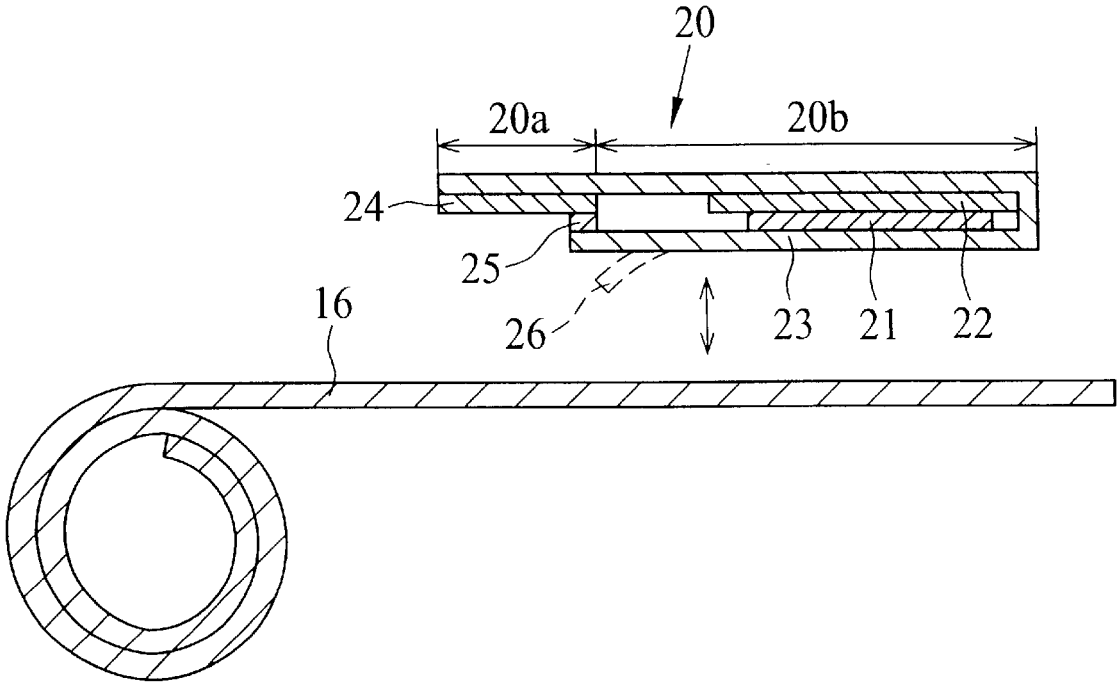
FIG. 8 shows a cross-sectional view of a sealing tape of Embodiment 2 of the invention.
Figure 9:
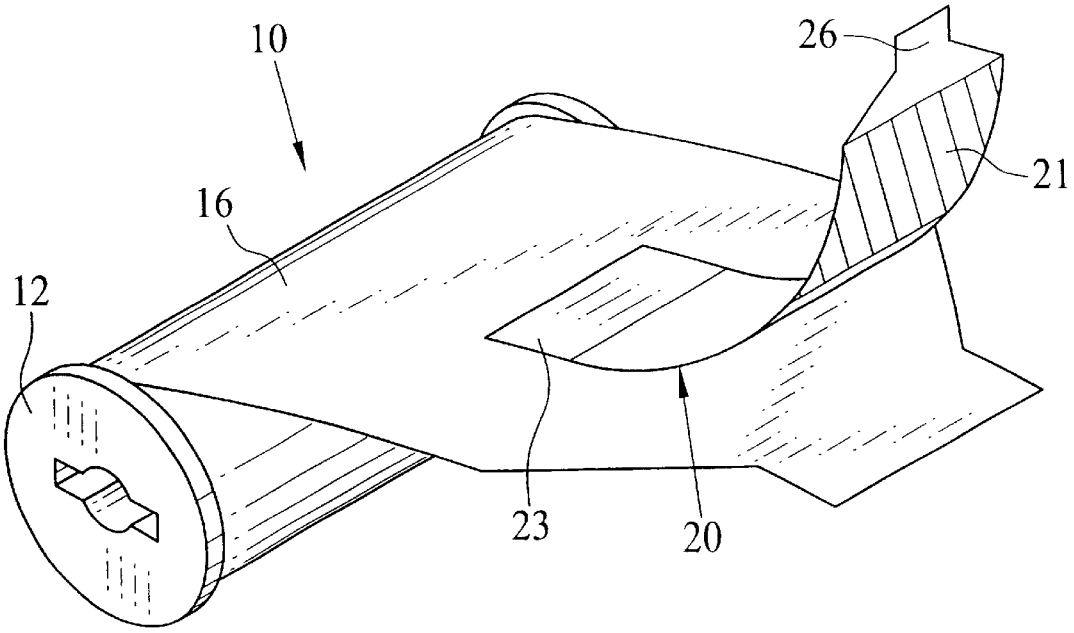
FIG. 9 shows an external perspective view of a fully exposed roll film with unfolded sealing tape of Embodiment 2 (FIG. 8) of the invention.

In FIGS. 8 and 9, a sealing tape 20 for a roll film is shown where the same sealing tape 20 is secured to the light-shielding trailer 16 in the opposite direction to the above described Embodiment 1; namely, the sealing tape 20 is secured to the light-shielding trailer 16 by bonding portion 20*a* in a leading side. In this embodiment, the sealing tape 20 is not bent over when advancing in the camera because the leading end portion of the sealing tape 20 is secured to the light-shielding trailer 16. A user pulls up the sealing tape 20 to expose the tab 26 and then pulls apart the tab 26 to unfold the sealing tape 20 to expose the tacky layer 21, and then wraps the unfolded and spread-out sealing tape 20 around the roll of film 10 across the trailing edge of the light-shielding trailer 16 and presses the tacky layer 21 against the surface of the trailer 16 while preventing the roll of film 10 from loosening.

Figure 10:
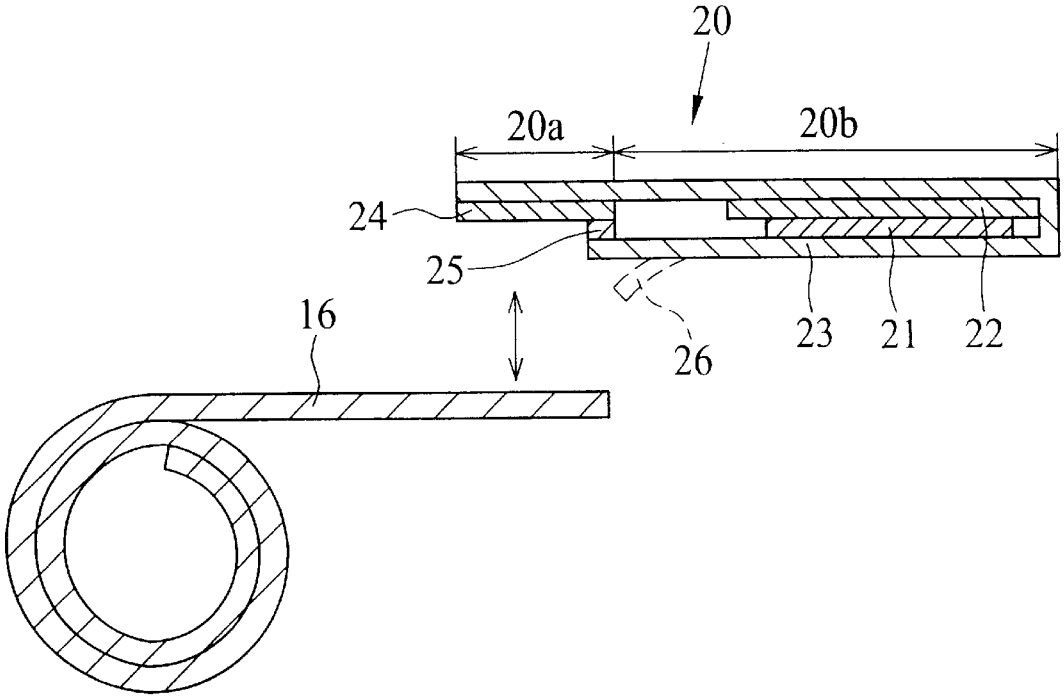
FIG. 10 shows a cross-sectional view of a sealing tape of Embodiment 2 (FIG. 8) of the invention where the sealing tape is secured to a trailing end portion of a light-shielding trailer.

In this embodiment, it is possible to shift the position where the first bond layer 24 is securely adhered to the light-shielding trailer 16 to the trailing end portion of the light-shielding trailer 16, as shown in FIG. 10, so that the tab 26 can emerge from the trailing end edge of the light-shielding trailer 16, which makes it easier for a user to pull apart the tab.

It is also possible to remove the second bond layer 25 and to have the release layer or both the release layer and the tacky layer in the area beneath the tab 26.

Embodiment 3

Figure 11:
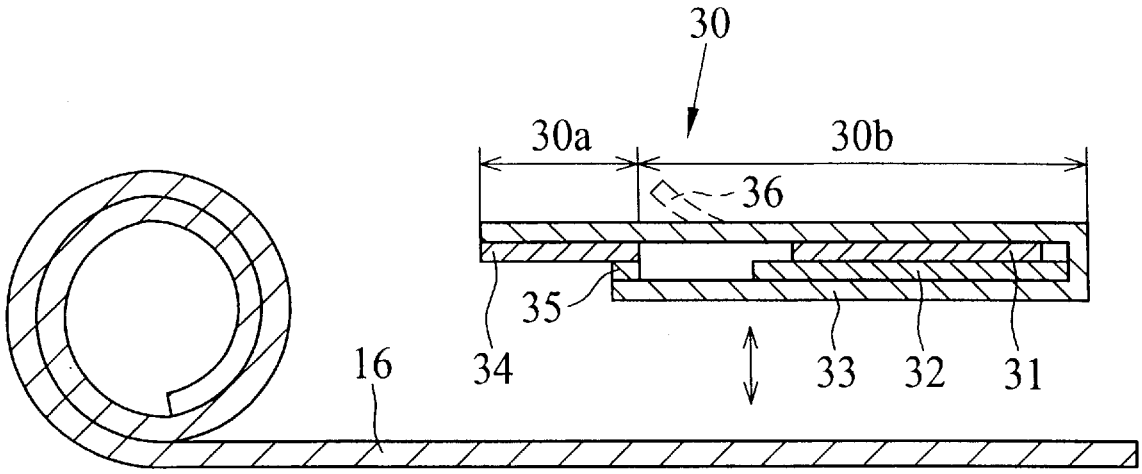
FIG. 11 shows a cross-sectional view of a sealing tape of the embodiment 3 of the invention where the sealing tape is secured to an inner surface of the light-shielding trailer.
Figure 12:
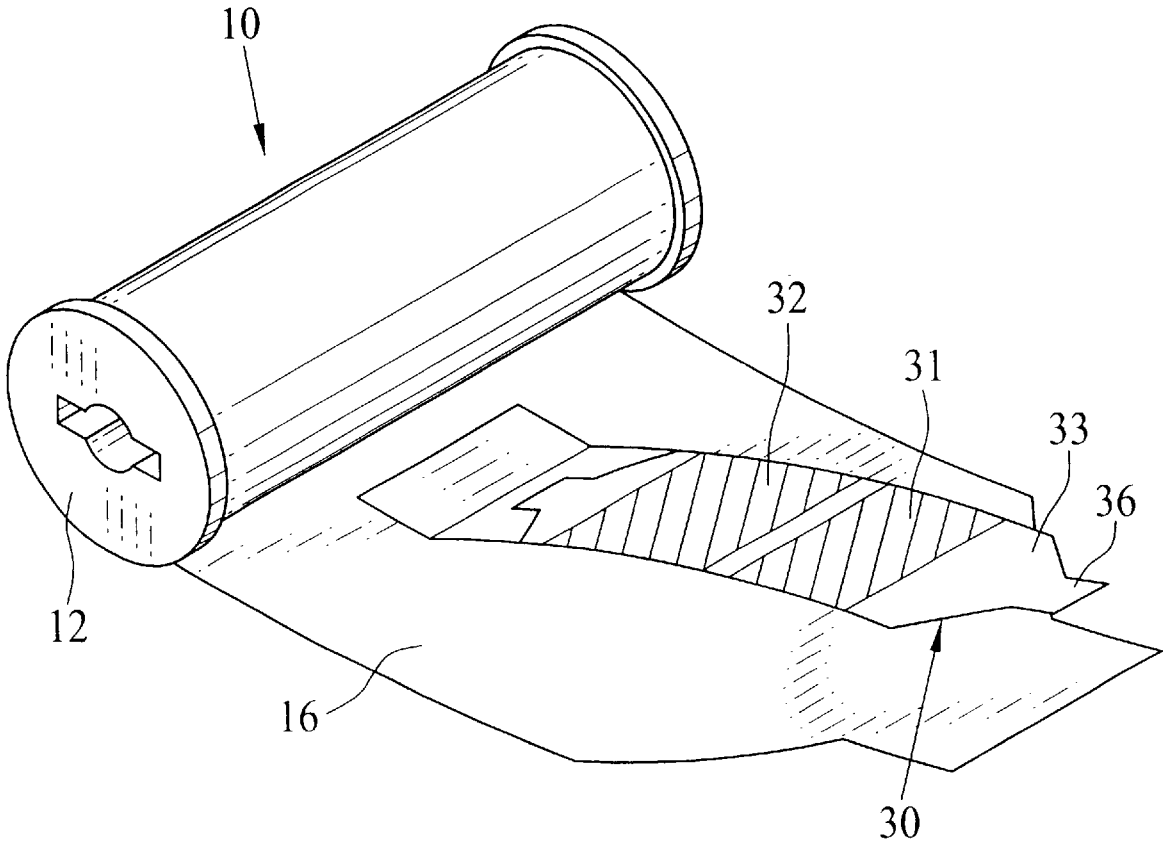
FIG. 12 shows an external perspective view of a fully exposed roll film with unfolded sealing tape of Embodiment 3 (FIG. 11) of the invention.

In FIGS. 11 and 12, a sealing tape 30 for a roll film is shown where the sealing tape 30 is secured to the light-shielding trailer 16 in the same direction as Embodiment 2; namely, a bonding portion 30*a* of the sealing tape 30 secured to the light-shielding trailer 16 is located in the leading side in the film advancing direction. However, the sealing tape 30 is secured to the inner surface of the light-shielding trailer 16 at its bonding portion 30*a* via a first bond layer 34 coated on one end portion (first end portion) of the tape base 33, unlike Embodiments 1 and 2 where the sealing tape securely adheres to the outer surface of the light-shielding trailer.

In a release portion 30*b* of the sealing tape 30, a tape base 33 is folded over toward the inner surface of the light-shielding trailer 16. The folded-over portion (release portion 30*b* of the sealing tape) has an inside which includes a tacky layer 31 and a release layer 32 which are weakly adhered to each other. A second bond layer 35 is coated on the other end portion (second end portion) of the folded-back tape base 33 to adhere securely to part of the first bond layer 34. A tab 36 is formed between the fold and the first bond layer 34. Perforations for tearing off are formed on both sides of the tab 36.

In this embodiment, the sealing tape 30 is not bent over when advancing in the camera. A user pulls up and apart the tab 36 to unfold the sealing tape to expose the tacky layer 31, and then wraps the unfolded and spread-out sealing tape 30 together with the light-shielding trailer 16 around the roll of film 10 across the trailing edge of the light-shielding trailer 16 and presses the tacky layer 31 through the light-shielding trailer 16 against the outer surface of the same one turn ahead while preventing the roll of film 10 from loosening.

It is possible to reverse the direction of securing the sealing tape 30. It is also possible to remove the second bond layer 35 and to have the release layer or both the release layer and the tacky layer in the area beneath the tab 36.

Embodiment 4

Figure 13:
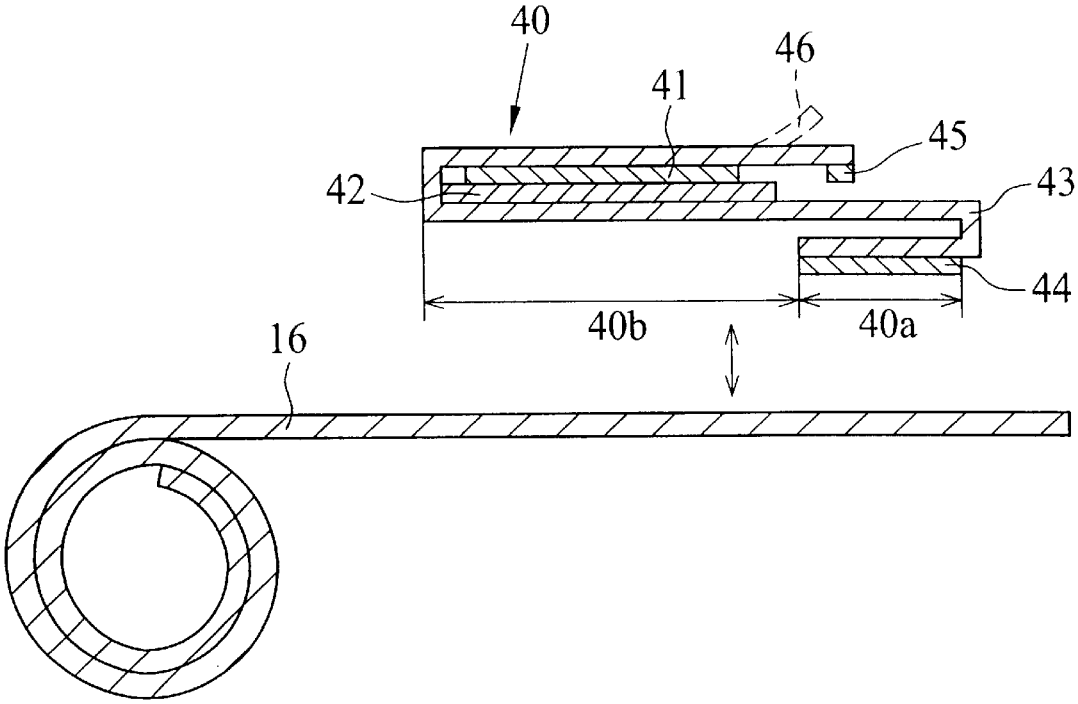
FIGS. 13 and 13A show cross-sectional views of a sealing tape of Embodiment 4 of the invention where the sealing tape is folded in an S-shape.
Figure 14:
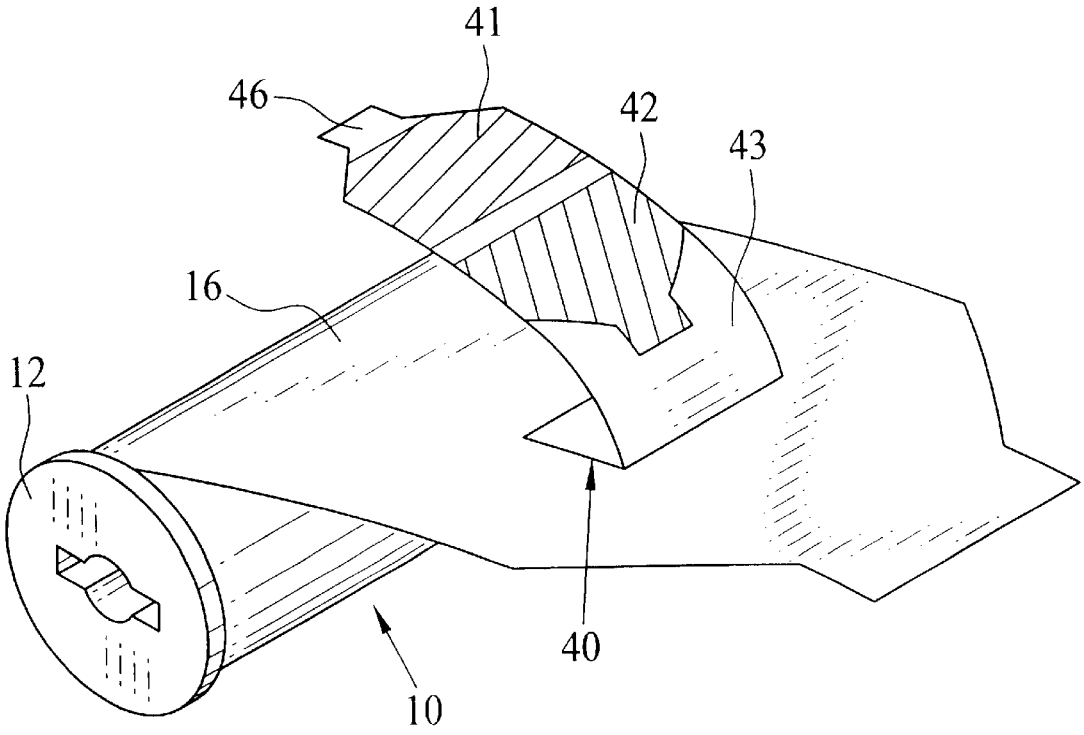
FIG. 14 shows an external perspective view of a fully exposed roll film with unfolded sealing tape of Embodiment 4 (FIG. 13) of the invention.
Figure 13A:
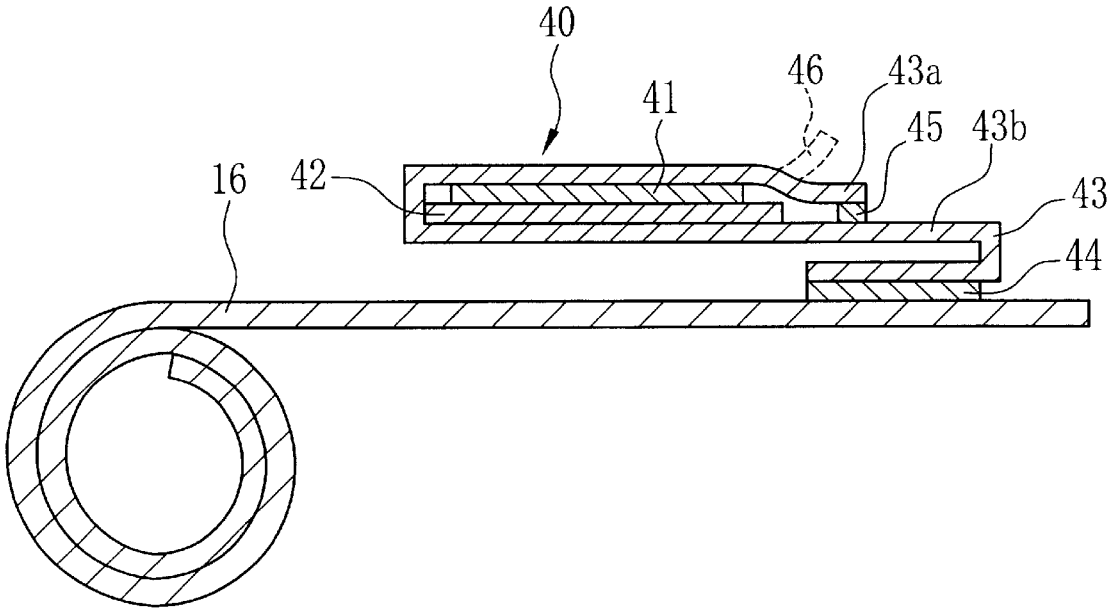

In FIGS. 13, 13A and 14, a sealing tape for a roll film is shown where the sealing tape 40 includes a tape base 43 folded into an S-shape. The S-shaped tape base 43 has a bonding portion 40*a* adhering securely to the outer surface of the light-shielding trailer 16 and a release portion 40*b*. The bonding portion 40*a* has a first bond layer 44 and the release portion 40*b* includes a tacky layer 41 and a release layer 42 which directly face each other and adhere with a low-strength adhesion. At one end portion (second end portion) of the tape base 43 opposite to the bonding portion 40*a* is coated a second bond layer 45 which adheres securely to the tape base 43.

As shown in the drawings, the first fold forming an S-shape is made along one edge of the bonding portion 40*a* and a second fold is made along the line drawn between the release layer 42 and the tacky layer 41. A tab 46 with perforations is formed between the second bond layer 45 and the tacky layer 41. FIG. 13A shows a second end 43*a* of the tape base 43 secured to a first folded-over portion 43*b*.

As in Embodiment 1, release portion 40*b* of the sealing tape 40 is bent over while being transported in the camera because the sealing tape 40 is secured to the light-shielding trailer 16 only at the bonding portion 40*a* located in a trailing side. However, the tacky layer 41 is never peeled off from the release layer 42 to be exposed because the second bond layer 45 securely adheres to the tape base 43.

A user bends back the bent portion of the sealing tape 40 and pulls up the tab 46 to unfold the sealing tape 40 so that the tacky layer 41 is separated from the release layer 42 to be exposed as shown in FIG. 14, and then wraps the unfolded and spread-out sealing tape 40 around the roll of film 10 in the reverse direction to Embodiment 1 across the trailing edge of the light-shielding trailer 16 and presses the tacky layer 41 against the surface of the trailer 16 while preventing the roll of film 10 from loosening.

It is possible to reverse the direction of securing the sealing tape 40 to the light-shielding trailer 16. It is also possible to have the release layer or both the release layer and the tacky layer in the area beneath the tab 46.

Embodiment 5

Figure 15:
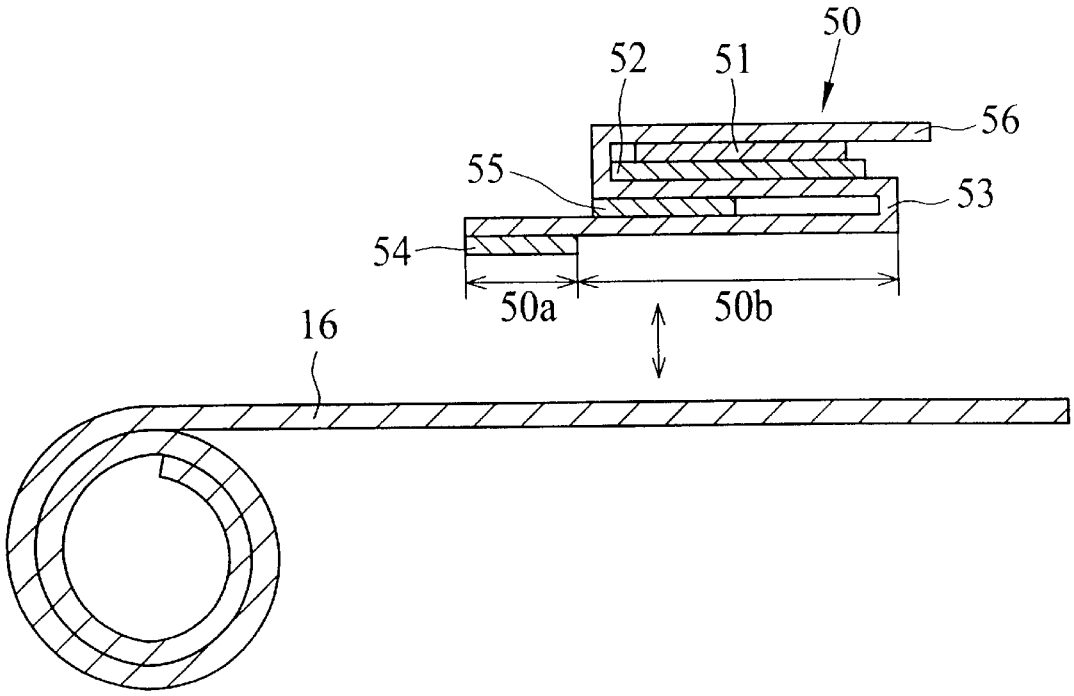
FIG. 15 shows a cross-sectional view of a sealing tape of Embodiment 5 of the invention where two portions of a tape base are adhered to each other with a medium/low-strength adhesive layer.
Figure 16:
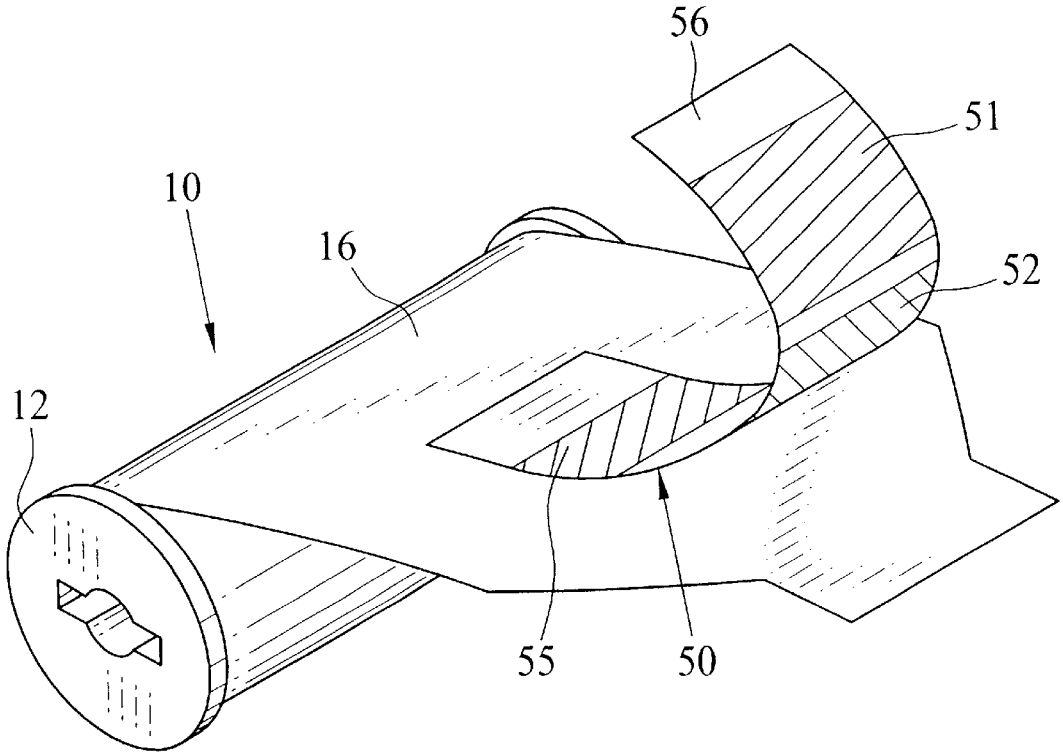
FIG. 16 shows an external perspective view of a fully exposed roll film with unfolded sealing tape of Embodiment 5 (FIG. 15) of the invention.

In FIGS. 15 and 16, a sealing tape for a roll film is shown where there is no tab for pulling up to unfold a sealing tape unlike in the other embodiments.

A sealing tape 50 includes an S-shaped release portion. A bonding portion 50*a* of the sealing tape 50 including the S-shaped release portion is secured to the light-shielding trailer 16 and is located in the leading side in the film advancing direction. A release portion 50*b* includes a tacky layer 51 and a release layer 52 which directly face each other and adhere with a low-strength adhesion. An upper U-shaped folded portion of the S-shaped sealing tape 50 is provisionally secured to the surface of a bottom portion of the same with a medium/low-strength adhesive layer 55, which prevents the tape base 53 (upper U-shaped portion of the S-shaped release portion) from being bent and the S-shape from collapsing while the sealing tape 50 advances in the camera.

The adhesion strength of the adhesive layer 55 is weaker than that of a bond layer 54 so that a user can unfold the S-shape to spread out the sealing tape by pulling the rear end 56 of the tape base 53. Then, the user wraps the unfolded and spread-out sealing tape 50 around the roll of film 10 in the reverse direction to Embodiment 1 across the trailing edge of the light-shielding trailer 16 and presses the tacky layer 51 against the surface of the trailer 16.

It is possible to reverse the direction of securing the sealing tape 50 to the light-shielding trailer 16.

Embodiment 6

Figure 17:
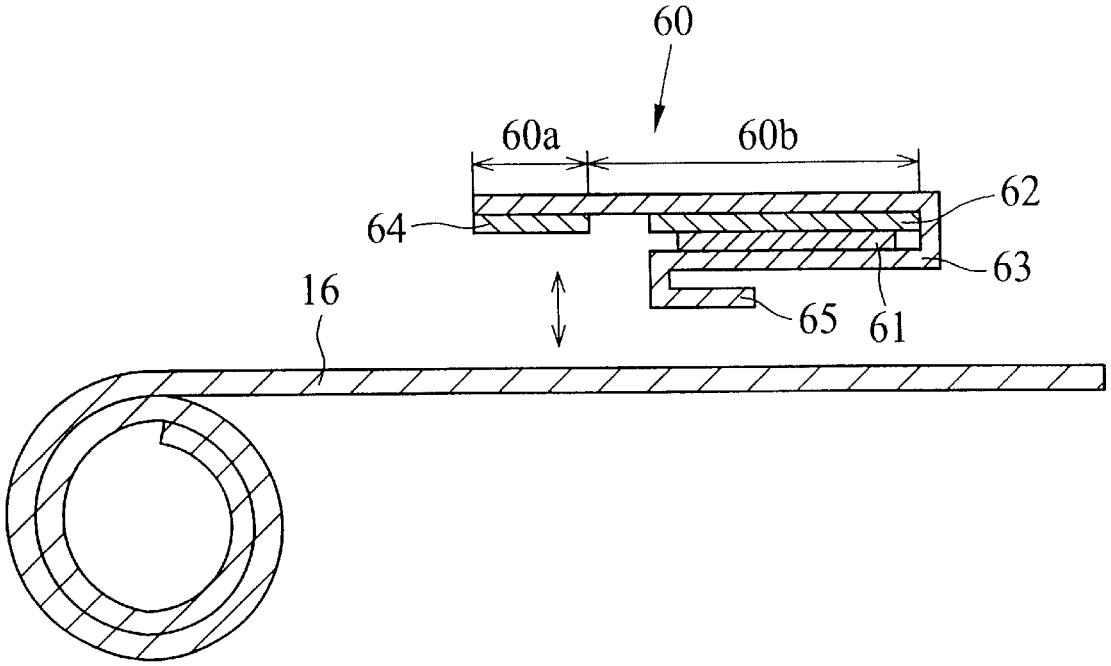
FIG. 17 shows a cross-sectional view of a sealing tape of Embodiment 6 of the invention where one end portion of a tape base is folded back to function as a tab.
Figure 18:
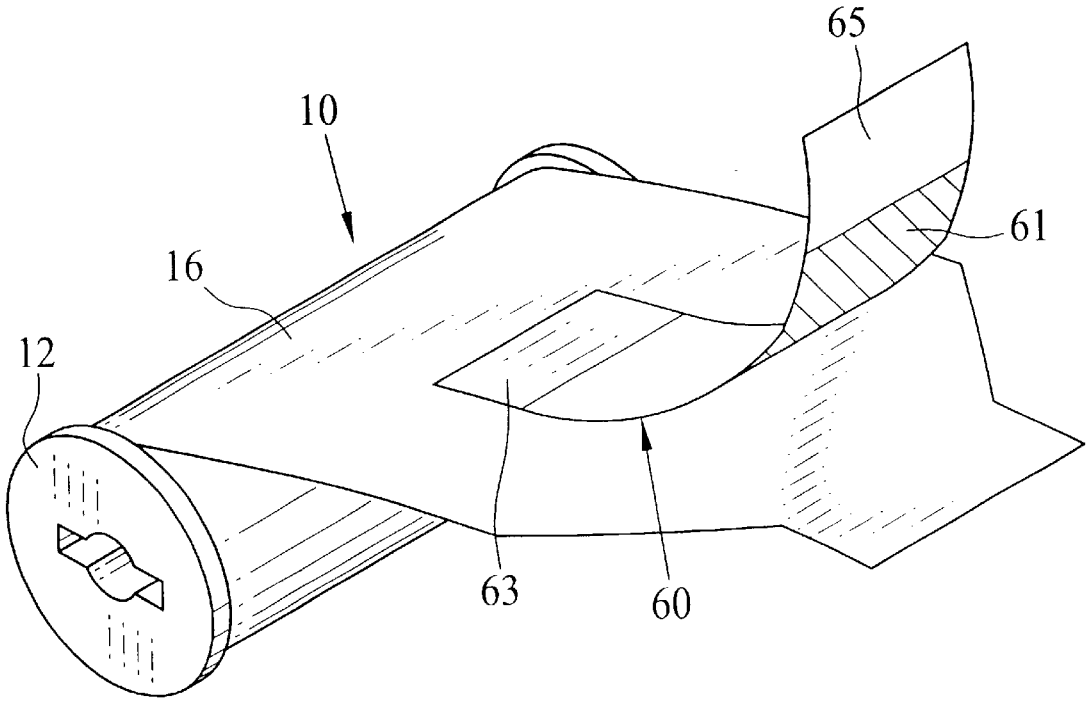
FIG. 18 shows an external perspective view of a fully exposed roll film with unfolded sealing tape of Embodiment 6 (FIG. 17) of the invention.

In FIGS. 17 and 18, a sealing tape for a roll film is shown which has a sealing tape 60 that is a modification of Embodiment 2 illustrated in FIGS. 8 and 9. The sealing tape 60 is the same as the one formed by removing the second bond layer 25 and the pulling-apart tab 26 from the sealing tape in FIG. 8 and adding fold-back instead thereto. A bond layer 64 is disposed in a bonding portion 60*a* at one end portion of a tape base 63 (the leading end portion of the sealing tape 60), the other end portion 65 is folded back to function as the tabs as in the other embodiments, and a release portion 60*b* is therebetween where a tacky layer 61 and a release layer 62, which are coated on the tape base 63 separately, directly face each other.

Figure 19:
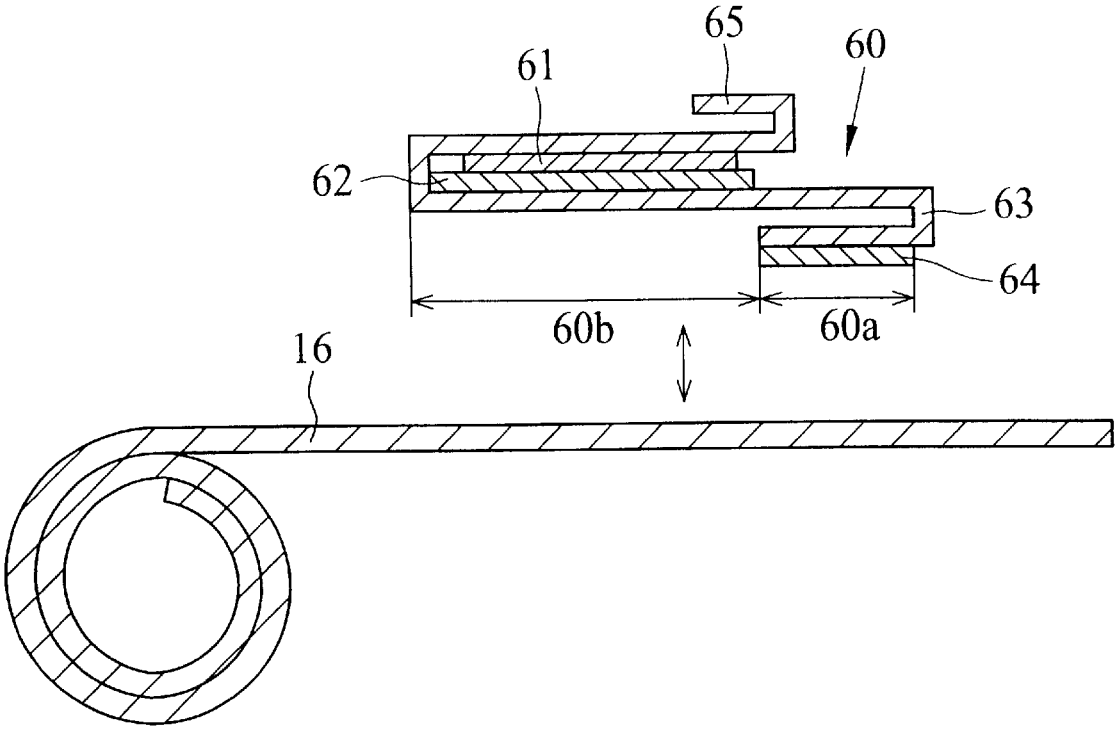
FIG. 19 shows a cross-sectional view of another sealing tape modified from the sealing tape of Embodiment 6 (FIG. 17) of the invention.

It is possible to extend the other end portion 65 to emerge from the edge of release portion 60*b*, for example, to form a Z-shape, which makes it easier for a user to pick up and pull up the other end portion 65 to unfold the sealing tape 60. FIG. 19 shows another modification which has a tab-alternative 65 upside of the sealing tape.

Embodiment 7

Figure 20A:
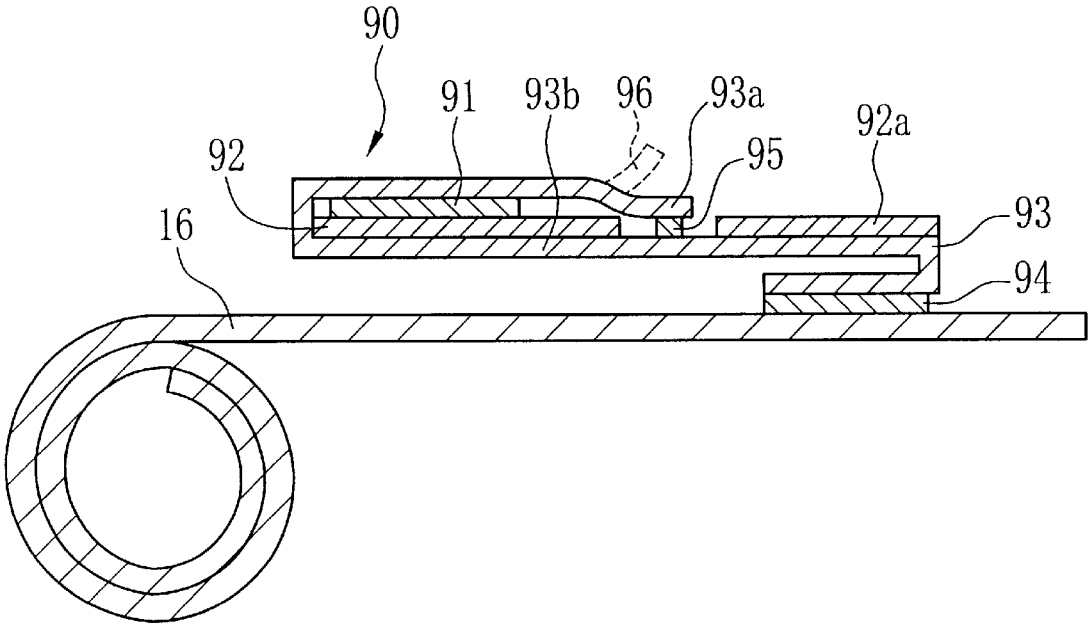
FIGS. 20 and 20A show cross-sectional views of a sealing tape of Embodiment 7 of the invention where two separate perforated-lines for tearing-off are formed for preventing the sealing tape from serious damage caused by accidental pulling-up of a tab.
Figure 20:
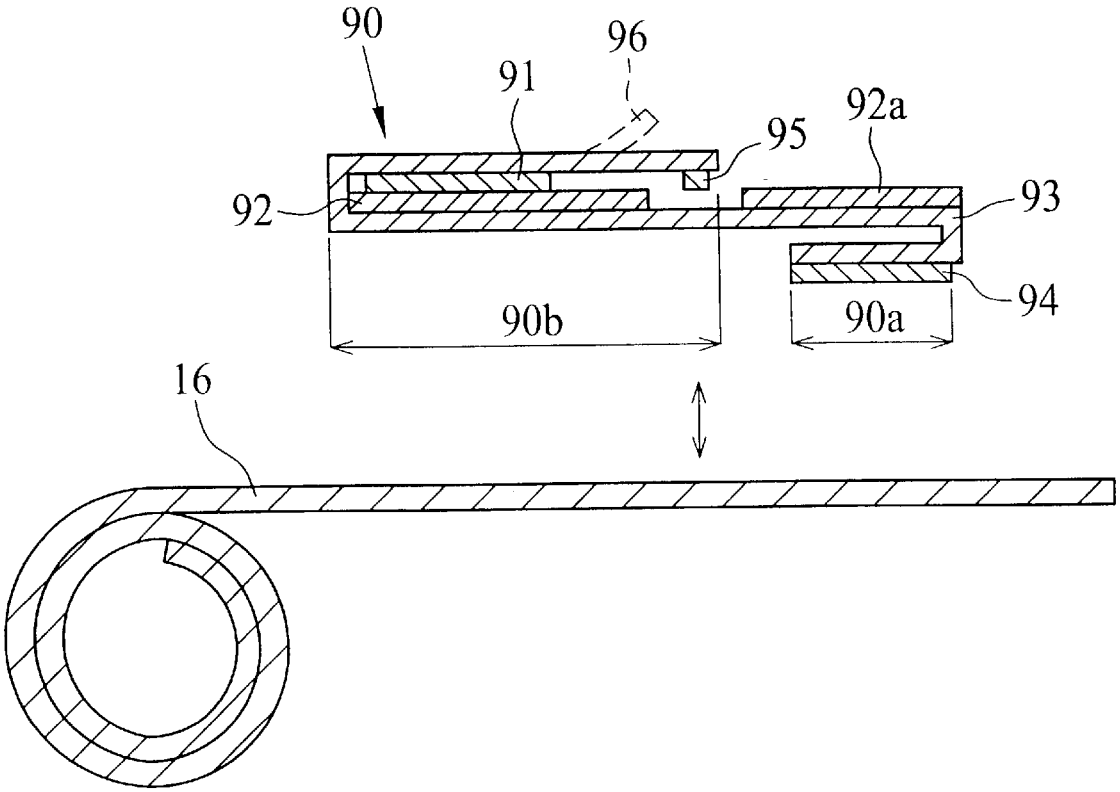
Figure 21:
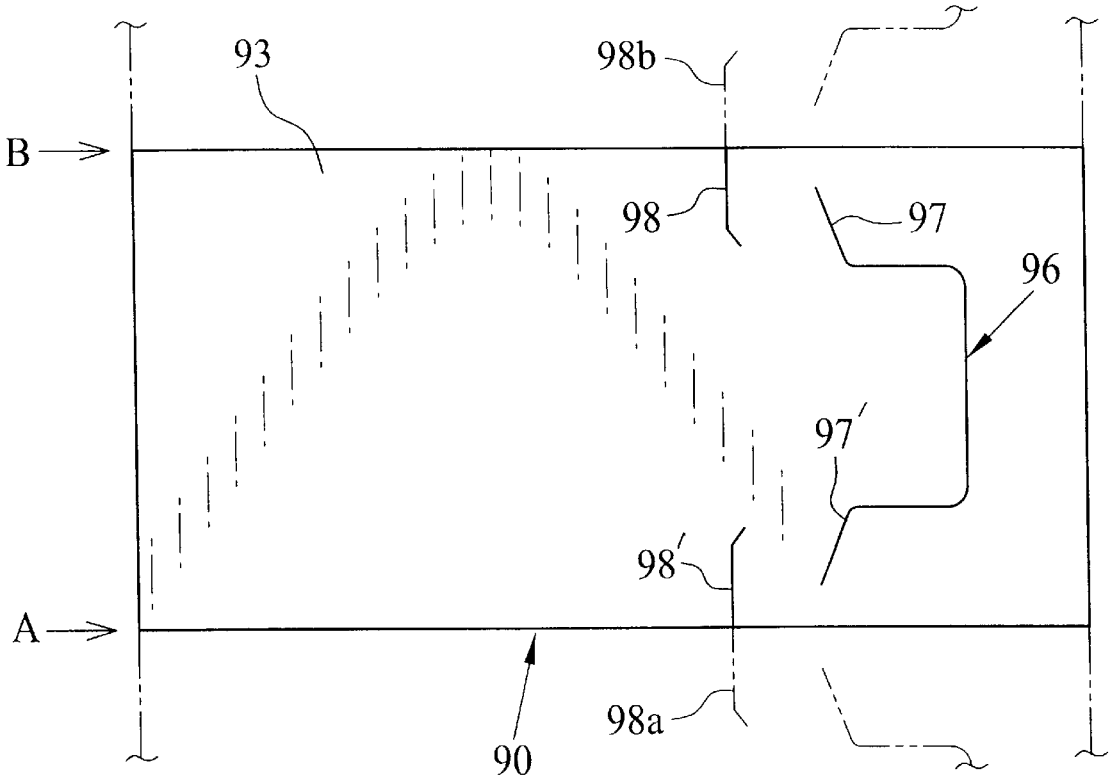
FIG. 21 shows an explanatory diagram illustrating separate perforated-lines of Embodiment 7 (FIG. 20) of the invention.
Figure 22:
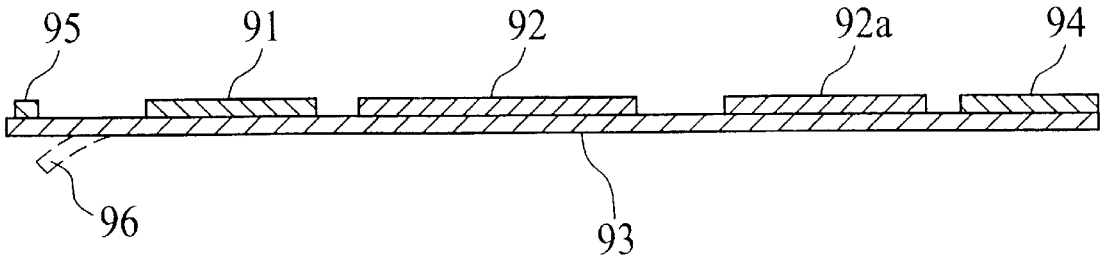
FIG. 22 shows a cross-sectional view of a tape base for a sealing tape of Embodiment 7 (FIG. 20) of the invention.
Figure 24:
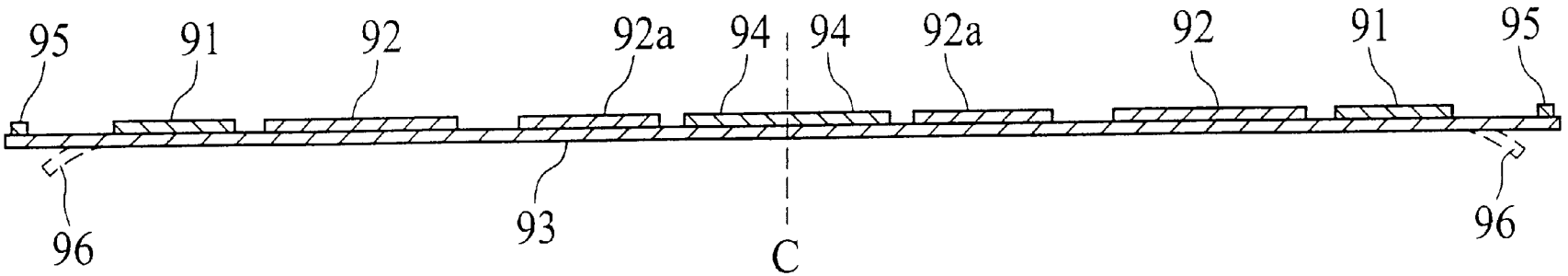
FIG. 24 shows a cross-sectional view of a tape base used in a manufacturing process for making a sealing tape of Embodiment 7 (FIG. 20) of the invention.
Figure 25:
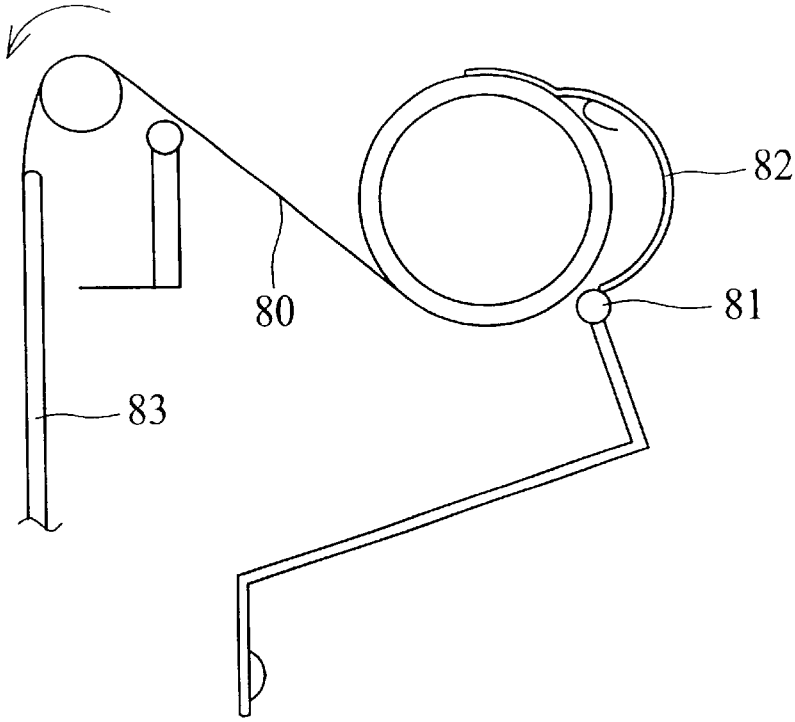
FIG.25 (PRIOR ART)
FIG. 25 shows an explanatory diagram illustrating conventional sealing tape hitting a spring member in a camera.
Figure 26:
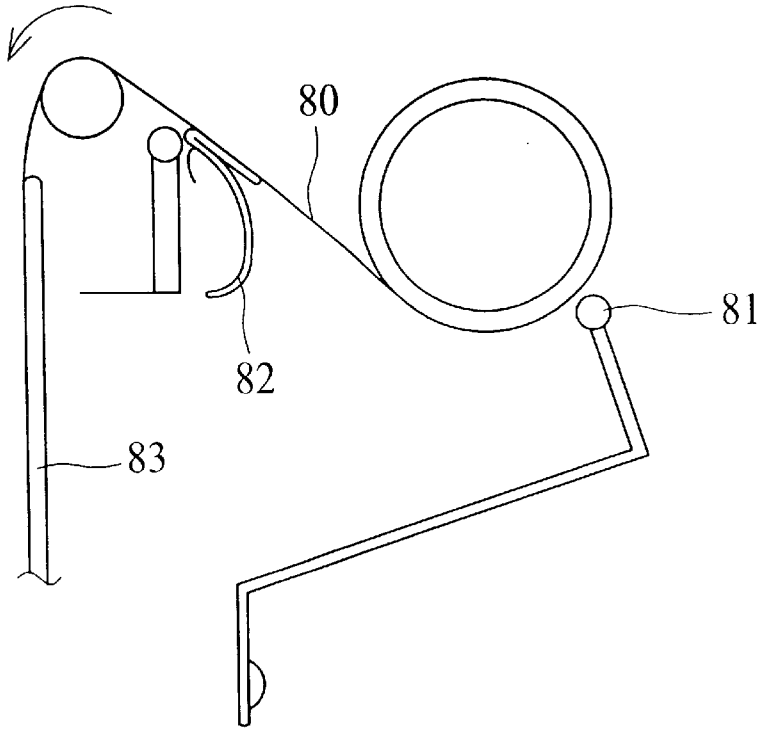
FIG.26 (PRIOR ART)
FIG. 26 shows an explanatory diagram illustrating conventional sealing tape being bent over in the camera.
Figure 27:
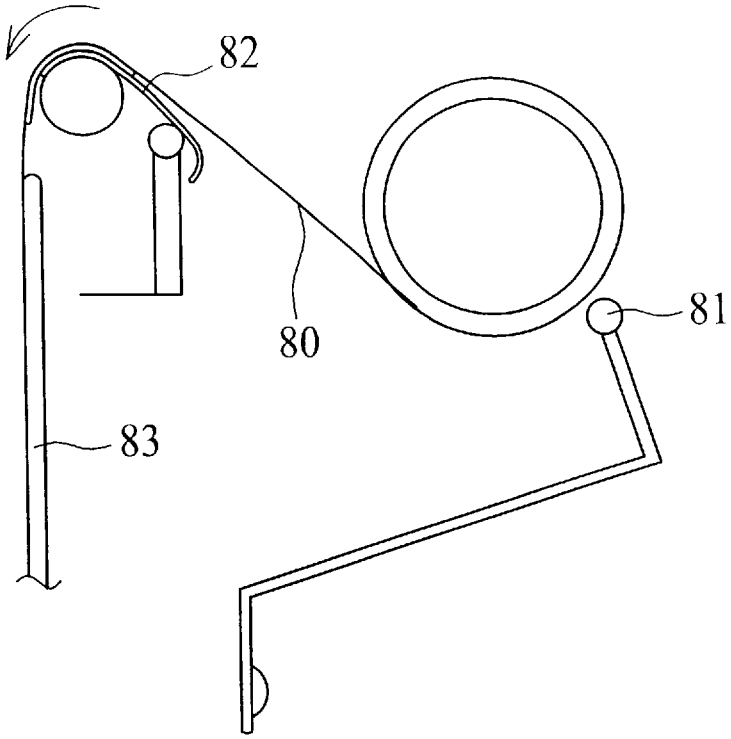
FIG.27 (PRIOR ART)
FIG. 27 shows an explanatory diagram illustrating conventional sealing tape being transported in the camera.
Figure 28:
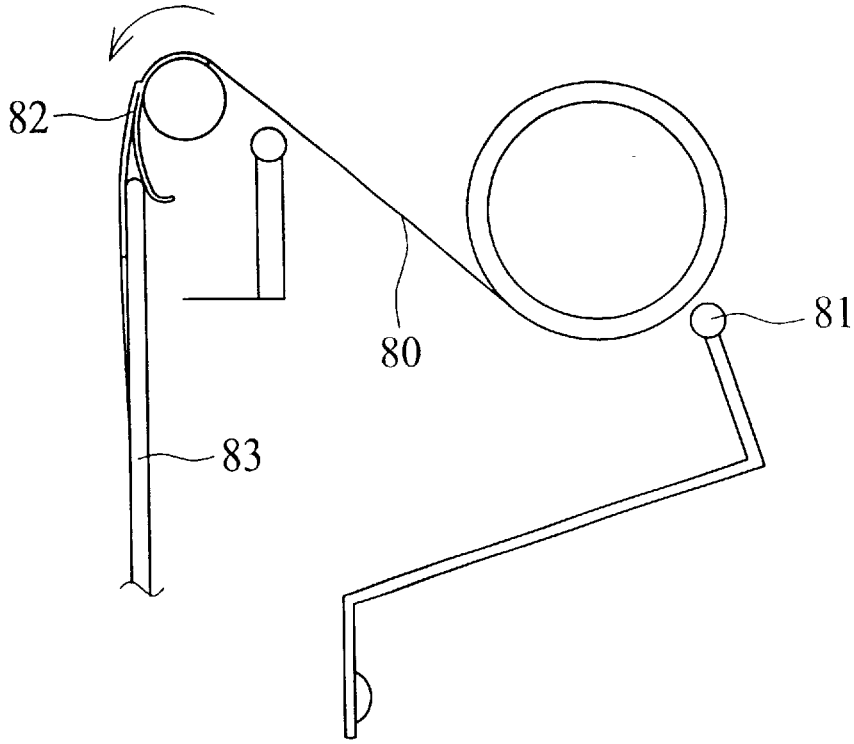
FIG.28 (PRIOR ART)
FIG. 28 shows an explanatory diagram illustrating a tacky layer of conventional sealing tape being scratched off in the camera.

FIGS. 20, 20A and 21 show a sealing tape for a roll film which is similar to Embodiment 4. The main differences between this embodiment and Embodiment 4 illustrated by FIGS. 13, 13A and 14 are that an additional release layer is added and the tab function is improved in this embodiment. As shown in FIG. 24, added to the one in FIG. 13 is an additional or second release layer 92*a* next to release layer 92 which corresponds to the release layer 42 in FIG. 13. The sealing tape 90 is manufactured by means such that a tape base 93 includes a tacky layer 91, a release layer 92, an additional release layer 92*a*, a first bond layer 94 and a second bond/tacky layer 95 as shown in FIG. 22 are folded between the tacky layer 91 and the release layer 92 to make them directly face each other, and between the second release layer 92*a* and the first bond layer 94 to make their backs face each other. FIG. 20A shows a second end 93*a* of the tape base 93 secured to a first folded-over portion 93*b*.

The tabs described previously have a perforated-line for tearing off, on both sides thereof, which reaches a lateral edge of the sealing tape. In those embodiments, it may happen that the tab is hooked over some members in the camera when advancing, such as a pressure plate for keeping flatness of the film or a spring member for preventing the roll of film from loosening. Once this happens, the tab is easily pulled up and apart in the camera and the sealing tape is damaged due to the tacky layer and the release layer being exposed.

FIG. 21 shows an improved perforated-line, having a tab 96, where the perforated-line for tearing off is divided into two separate parts, first perforated-line 97 and 97' and second perforated-line 98 and 98'. The pair of first perforated-lines 97 and 97' do not reach the lateral edges of the sealing tape. The pair of second perforated-lines 98 and 98', which are formed and located slightly away from the first lines 97 and 97' in the direction for peeling the tab, namely becomes closer to a tacky layer, and reaches the lateral edges of the sealing tape 90. The second lines 98 and 98' are formed to make a right angle roughly with respect to the lateral edge of the sealing tape 90. Those two lines have an overlapped region in position in the lateral direction.

The improved perforations can prevent the sealing tape from serious damage, peeling-off the whole tape base, even if the tab is hooked over some members in the camera because of the short first line which does not reach the edge of the sealing tape and the separated second line. The improvement can also help a user to peel off the tape base certainly to unfold the sealing tape because the separated lines for tearing off work well even when the tab is pulled up in a diagonal direction.

Figure 23:
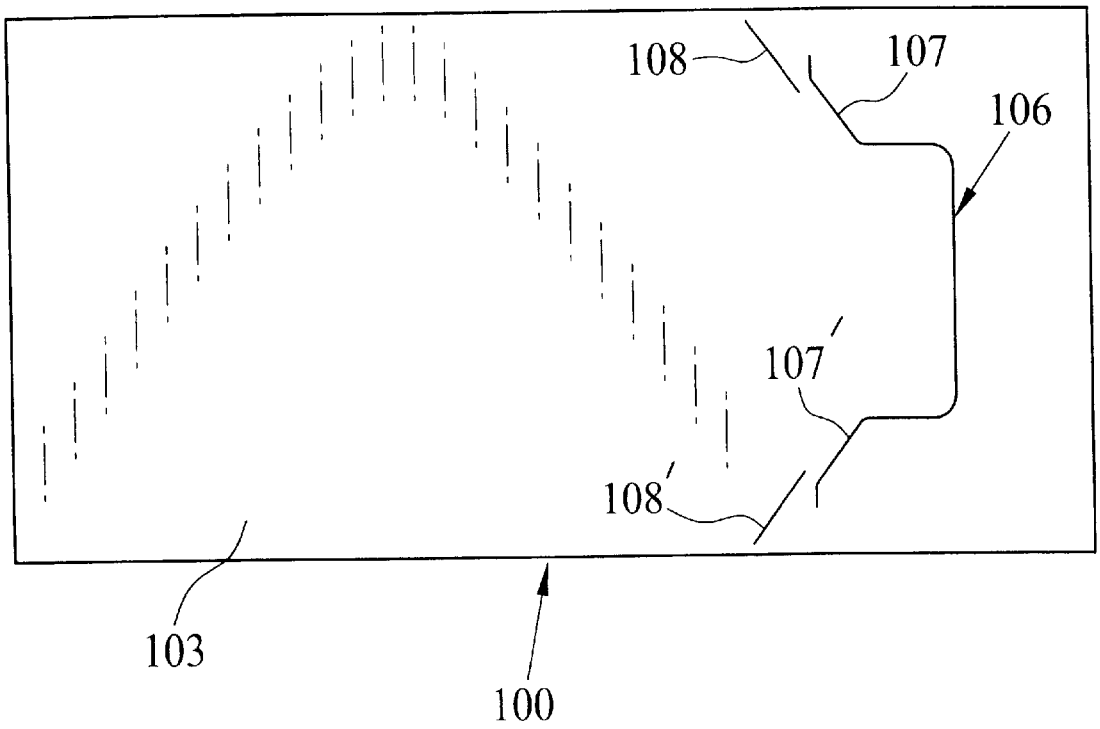
FIG. 23 shows another type of separate perforated-lines for tearing-off formed on a tape base of Embodiment 7 (FIG. 20) of the invention.

As shown in FIG. 23, the second line 108 and 108' can be formed at a closer position to the first line 107 and 107' connected to tab 106. The second line 108 and 108' is preferably parallel to the first line 107 and 107' and it is not necessary to reach the edge of the sealing tape 100. The second line can be formed on both sides of the first line. The improved tab systems, of course, can be used for sealing tapes not only in this Embodiment 7, but also in the other embodiments previously described.

FIGS. 21 and 24 are for explaining the manufacturing process of the sealing tape 90. One unit section of tape base 93 has the second bond/tacky layer 95, the tacky layer 91, the release layer 92, the additional release layer 92*a* and the first bond layer 94 which are formed symmetrical about a broken line C. A whole tape base, consisting of many unit sections, having respective layers is cut off or slit along the line C in FIG. 24 and lines A and B in FIG. 21. As shown in FIG. 21, the second perforated-line 98 and 98' is formed together with a second line 98*a* or 98*b* for the adjacent unit by cutting-off along the line A or B. This allows to have a rough positioning for cutting in terms of having the second line reach, with certainty, the edge of the sealing tape.

Length of the unfolded sealing tape 90 is usually between 60 mm and 150 mm, preferably between 80 mm and 120 mm, and the width is usually between 15 mm and 40 mm, preferably 20 mm and 30 mm. As for the position for fixing the sealing tape, the distance from the trailing end of the sealing tape 90 to the trailing end of the light-shielding trailer 16 is usually between 10 mm and 100 mm, preferably 50 mm and 80 mm.

Paper is preferably used for the tape base, and plastic film such as thin PET film or stretched PP film or synthetic paper is also available. In the case of paper, high-quality paper or coated paper with a basis weight from 50 g/m$^2$ to 120 g/m$^2$, and preferably from 60 g/m$^2$ to 80 g/m$^2$, is usually used.

With respect to a bond used for securely adhering the sealing tape to the light-shielding trailer, heat-sealing type adhesives or other heat-sealing agents are available. With respect to a tacky layer applied to a tape base of the sealing tape, materials capable of being applied by means of extrusion coating, roll coating or laminating are preferable. Hot-melt type tacky layers can be easily applied to the tape base because the tacky layer has a rubber resilience and stable characteristics over a wide range of temperatures. With a releasing agent for a release layer, UV curable-type silicon compounds are preferably used. As for tacky materials, it is required to use materials which are capable of remaining tacky even under very low temperatures such as when used in cold areas. Materials meeting this requirement are, for example, "DIABOND DA3051E", "DIABOND DA3051J" or "DIABOND DH683" which are hot-melt type tacky materials. UV curable-type silicon compounds tend to be stable releasing agents for the release layer by exposure to UV rays immediately after applying to the tape base.

The sealing tape has other functions, such as to represent a kind or size of the film, whether unexposed or already exposed, illustration of the tab and how to open the roll film, or something helpful for users. It may also represent a detecting mark for indicating a position for cutting off the tape base for making the sealing tape when it is supplied to a manufacturing process as a bulk roll. Colors of the mark can be selected according to kinds of film or defined to several colors. Using a defined color helps to obtain a stable output signal in mark position detecting, which leads to obtaining units of tape base with less variations in size.

To represent those described above, gravure printing or relief printing is used. Heat resistance type ink is recommended to be independent from heat provided by a heater block, which may otherwise cause lower quality prints, used in the process of securing the seal tape to the light-shielding paper. In the case of a UV curable-type ink, it is important to check whether prints are dried up before the printed tape base is transferred to the next process.

The invention has been described with respect to 220 type roll film. It is easily understood that the invention can also be applied to 120 type roll film and the like without modification.

It is contemplated that numerous modifications may be made to the apparatus and method of the present invention without departing from the spirit and scope of the invention as defined in the following claims.

What is claimed is:

1. A photographic roll film comprising:

a spool;

a roll of photographic film strip wound around the spool, a light shielding paper which covers the roll of the photographic film strip;

a sealing tape which keeps the light shielding paper covering the roll of the photographic film strip without loosening, wherein the sealing tape includes a bonding portion and a release portion which are made of a single tape base;

a first bond layer coated on the tape base in the bonding portion which secures a first end of the sealing tape to a surface of the light shielding paper;

a folded-over portion that is formed in the release portion by folding over the tape base; and a first tacky layer and a release layer that are separately coated on the tape base inside the folded-over portion and directly face each other;

wherein a second end portion of the tape base is secured to an end portion of the first bond layer.

2. A photographic roll film as defined in claim 1, further comprising one of a second bond layer and a second tacky layer that is coated on the second end portion of the tape base and glued to the first bond layer.

3. A photographic roll film as defined in claim 2, further comprising:

a tab that is formed in the tape base of the folded-over portion accompanied by a perforated-line which is used to tear off a part of the tape base to unfold the folded-over portion and expose the first tacky layer by which the light shielding paper around the roll of photographic film strip is sealed.

4. A photographic roll film as defined in claim 3, wherein the tab and the first tacky layer are formed with respect to a same side of the folded over portion.

5. A photographic roll film as defined in claim 4, wherein the perforated-line accompanying the tab reaches a lateral edge of the tape base.

6. A photographic roll film as defined in claim 5, wherein the tab is accompanied by a plurality of perforated-lines, one of which reaches a lateral edge of the tape base.

7. A photographic roll film as defined in claim 3, wherein the bonding portion is secured to an inner surface of the light shielding paper so as to be located in a leading side of the sealing tape in a film advancing direction, and the tab and the first tacky layer are formed with respect to a same side of the folded-over portion away from the light shielding paper.

8. A photographic roll film as defined in claim 7, wherein the perforated-line accompanying the tab reaches a lateral edge of the tape base.

9. A photographic roll film as defined in claim 7, wherein the tab is accompanied by a plurality of perforated-lines, one of which reaches a lateral edge of the tape base.

10. A photographic roll film as defined in claim 1, wherein a diameter of a shaft of the spool where the sealing tape is wound is smaller than an end portion of the spool by 0.1 mm to 0.6 mm.

11. A photographic roll film comprising:

a spool;

a roll of photographic film strip wound around the spool;

a light shielding paper for covering the roll of the photographic film strip;

a sealing tape which keeps the light shielding paper covering the roll of the photographic film strip without loosening, wherein the sealing tape includes a bonding portion and a release portion which are made of a single tape base;

a first folded-over portion that is formed in the bonding portion by folding over the tape base;

a first bond layer coated on the tape base on one side of the first folded-over portion for securing a first end of the sealing tape to a surface of the light shielding paper, a second folded-over portion that is formed in the release portion by folding over the tape base, wherein the second folded-over portion connects to the first folded-over portion to form S-shape;

a first tacky layer and a first release layer that are separately coated on the tape base inside the second folded-over portion and directly face each other;

a tab that is formed in the tape base of the second folded-over portion accompanied by a perforated-line for tearing off a part of the tape base to unfold the second-folded over portion and expose the first tacky layer by which the light shielding paper around the roll of the photographic film strip is sealed; and one of a second bond layer and a second tacky layer that is coated on the second end portion of the tape base and secured to the tape base.

12. A photographic roll film as defined in claim 11, wherein a second end of the tape base is secured to the first folded-over portion.

13. A photographic roll film as defined in claim 12, wherein the perforated-line accompanying the tab reaches a lateral edge of the tape base.

14. A photographic roll film as defined in claim 12, wherein the tab is accompanied by a plurality of perforated-lines, one of which reaches a lateral edge of the tape base.

15. A photographic roll film as defined in claim 11, wherein a second end of the tape base is secured to the second folded-over portion, and the first folded-over portion includes a second release layer.

16. A photographic roll film as defined in claim 15, wherein the perforated-line accompanying the tab reaches a lateral edge of the tape base.

17. A photographic roll film as defined in claim 15, wherein the tab is accompanied by a plurality of perforated-lines, one of which reaches a lateral edge of the tape base.

18. A photographic roll film as defined in claim 11, wherein a diameter of a shaft of the spool where the sealing tape is wound is smaller than an end portion of the spool by 0.1 mm to 0.6 mm.

19. A photographic roll film comprising:

a spool;

a roll of photographic film strip wound around the spool;

a light shielding paper for covering the roll of the photographic film strip;

a sealing tape which keeps the light shielding paper covering the roll of the photographic film strip without loosening, wherein the sealing tape includes a bonding portion and a release portion which are made of a single tape base;

a first folded-over portion that is formed in the bonding portion by folding over the tape base;

a bond layer coated on the tape base on one side of the first folded-over portion which secures a first end of the sealing tape to a surface of the light shielding paper;

an S-shaped second folded-over portion that is formed in the release portion by folding the tape base twice;

a tacky layer and a release layer that are separately coated on the tape base inside an upper folded portion of the S-shaped second folded-over portion and directly face each other; and an adhesive layer coated inside a lower folded portion of the S-shaped second folded-over portion, wherein an adhesive strength of the adhesive layer is less than that of the bond layer of the bonding portion so that a user can easily peel apart the S-shaped second folded-over portion.

20. A photographic roll film as defined in claim 19, wherein a diameter of a shaft of the spool where the sealing tape is wound is smaller than an end portion of the spool by 0.1 mm to 0.6 mm.

21. A photographic roll film comprising:

a spool;

a roll of photographic film strip wound around the spool;

a light shielding paper which covers the roll of the photographic film strip;

a sealing tape which keeps the light shielding paper covering the roll of the photographic film strip without loosening, wherein the sealing tape includes a bonding portion and a release portion which are made of a single tape base;

a bond layer coated on the tape base in the bonding portion which secures a first end of the sealing tape to a surface of the light shielding paper;

a folded-over portion that is formed in the release portion by folding over the tape base; and a tacky layer and a release layer that are separately coated on the tape base inside the folded-over portion and directly face each other;

wherein a second end portion of the tape base is folded back to form a Z-shape.

22. A photographic roll film as defined in claim 21, wherein a diameter of a shaft of the spool where the sealing tape is wound is smaller than an end portion of the spool by 0.1 mm to 0.6 mm.

23. A photographic roll film comprising:

a spool;

a roll of photographic film strip wound around the spool;

a light shielding paper which covers the roll of the photographic film strip;

a sealing tape which keeps the light shielding paper covering the roll of the photographic film strip without loosening, wherein the sealing tape includes a bonding portion and a release portion which are made of a single tape base;

a first folded-over portion that is formed in the bonding portion by folding over the tape base;

a bond layer coated on the tape base on one side of the first folded-over portion which secures a first end of the sealing tape to a surface of the light shielding paper, a second folded-over portion that is formed in the release portion by folding over the tape base, wherein the second folded-over portion connects to the first folded-over portion to form a S-shape; and a tacky layer and a release layer that are separately coated on the tape base inside the second folded-over portion and directly face to each other; wherein a second end of the tape base is folded back.

24. A photographic roll film as defined in claim 22, wherein a diameter of a shaft of the spool where the sealing tape is wound is smaller than an end portion of the spool by 0.1 mm to 0.6 mm.

* * * * *